US006514008B1

(12) United States Patent
Smolnik

(10) Patent No.: US 6,514,008 B1
(45) Date of Patent: Feb. 4, 2003

(54) DEVICE FOR SEALING MANHOLE COVERS TO CHIMNEYS

(76) Inventor: John A. Smolnik, 112 Mountain Top Rd., Wernersville, PA (US) 19565

( * ) Notice: Subject to any disclaimer, the term of this patent is extended or adjusted under 35 U.S.C. 154(b) by 100 days.

(21) Appl. No.: 09/694,269

(22) Filed: Oct. 24, 2000

(51) Int. Cl.[7] ..... E02D 29/14
(52) U.S. Cl. ..... 405/26; 404/25; 52/20
(58) Field of Search ..... 404/22–26; 49/505; 52/19–21

(56) References Cited

U.S. PATENT DOCUMENTS

| | | | | | |
|---|---|---|---|---|---|
| 4,540,310 | A | * | 9/1985 | Ditcher et al. | 404/25 |
| 5,362,175 | A | * | 11/1994 | Begin | 404/26 |
| 5,564,855 | A | * | 10/1996 | Anderson | 404/26 |
| 5,732,512 | A | * | 3/1998 | Ueno et al. | 52/19 |
| 6,161,984 | A | * | 12/2000 | Sinclair | 404/25 |
| 6,196,760 | B1 | * | 3/2001 | Sinclair | 404/26 |

FOREIGN PATENT DOCUMENTS

| | | |
|---|---|---|
| DE | 3414762 | * 10/1985 |
| GB | 2280923 | * 2/1995 |

* cited by examiner

*Primary Examiner*—David Bagnell
*Assistant Examiner*—Sunil Singh
(74) *Attorney, Agent, or Firm*—Richard L. Huff

(57) ABSTRACT

A kit for connecting and sealing a manhole cover frame to the upper surface of a chimney and a method of using the kit. The kit contains a spacer which may be cut to the proper length and to make allowances for any grade in the surface, a top flange which holds the top of the spacer to the manhole cover frame, and a bottom flange which holds the spacer to the upper surface of the chimney. The surfaces of the flanges which contact the lower surface manhole cover frame and the upper surface of the chimney contain coaxial recesses for holding butyl rubber sealant material in rope form. Watertight seals may be made with the use of light pressure. Additionally, the lower flange may be connected to the chimney with bolts. The surfaces of the flanges contacting the spacer contain a plurality of coaxial protrusions. The ends of the spacer are fitted with gaskets and sealed into the spaces between the protrusions on the top and bottom flanges to form watertight seals. The kit is used by applying a sealant material to the recess in the bottom surface of the the bottom flange, sealing the bottom flange to the chimney, cutting the spacer to the proper length and angle, applying gaskets to the top and bottom ends of the spacer, sealing the spacer to the flanges, and adhering the top flange to the manhole cover frame with the use of a sealant material.

16 Claims, 6 Drawing Sheets

DEVICE FOR SEALING MANHOLE COVERS TO CHIMNEYS

BACKGROUND OF THE INVENTION

1. Field of the Invention

This invention relates to an improved method of connecting a manhole frame to a manhole chimney so that the manhole frame has the desired grade and a kit for carrying out this method.

2. Description of the Related Art

Underground water, sewage, and utility wire systems have existed for many years. Typically, these systems are adjacent to or underneath roadways. The need for access to these systems has necessitated the addition of access holes at various points along these systems. These access points, or manholes, are tapered to smaller access areas, or chimneys, which are connected, directly or indirectly, to manhole frames which are covered with manhole covers.

Manhole covers are generally made of cast iron or strong polymeric material, are circular in configuration, and have a diameter suitable to allow for covering manhole frames which allow the entrance and exiting of a utility worker. In use, the top surface of a manhole cover is preferably flush with the pavement or road surface so as to not generate a depression in the road, which would be the source of problems. One problem would be the unnecessary bumps for traveling vehicles. Another problem would be the creation of locations where water may accumulate and, by the expansion and contraction caused by freezing, cause cracks between the manhole frame and the surrounding pavement. These cracks then perpetuate a destructive process by admitting more water into the surrounding area, which aggravates the problem by subsequent freezing and thawing action. Therefore, it is desirable for both new road construction and repaving that manhole covers be flush with the pavement surface.

In the case of new road construction, current practice is to supply a pre-cast concrete manhole containing a narrowed chimney which is put in place in an excavated hole. These concrete manhole chimneys extend upward to usually less than two feet below the road surface. The distance between the chimney and the road surface allows for installing the manhole frame onto which the manhole cover is located in its final assembled position. The installation is done in such a way as to provide a flush fit between the manhole cover and the road surface. The distance between the chimney and the road surface is greater than the height of the manhole frame. This results in a space between the upper surface of the chimney and the lower surface of the manhole frame. In conventional practice, this space is filled with spacers such as bricks, mortar, cement block, or pre-cast concrete circular grade rings of different thicknesses, grouted in place. After the manhole frame is raised above the chimney by these spacers to the proper elevation and orientation, concrete is poured around the spacers and the manhole frame to form a sealed system extending from the chimney to the manhole frame. Because the manhole frame is initially buried with the chimney beneath the fresh pavement and then uncovered and raised into a correct position by the grade ring technique, this process of lifting and positioning the manhole frame is called "raising." One alternative to the above-mentioned spacers is discussed by Jonas et al in published UK Patent Application 2 280 923. This publication shows tapered boards made of a mixture of wood fiber and cement. By setting these boards in the proper position, the desired angle of the manhole frame may be obtained. Another alternative is shown in DE Pat. No. 3414-762 to Feit. This patent discloses a single wedge-shaped concrete spacer which fits between the chimney and the manhole frame. The installers may select a spacer having the proper angle from a variety of spacers at hand in order to obtain a manhole frame and cover which are flush with the pavement. Still another alternative is disclosed by Hinkle in U.S. Pat. No. 5,934,820. This patent discloses a one-piece pre-cast concrete spacer which may be trimmed on site to yield the desired angle of the manhole frame.

Disadvantages exist in the above systems for connecting the manhole frames to the chimneys. Some of these systems do no result in a manhole frame which is flush with the pavement surface. Some require the on-site presence of a number of spacers so that the installer may select the correct one. One requires the laborious cutting of concrete to obtain the proper angle. In all of these systems, when the road is to be repaved, the installed spacers should be removed and replaced by other spacers. As the original spacers are sealed with concrete, this results in the use of a large amount of labor. As a result of these disadvantages, a common practice is to simply leave the manhole covers at the original elevation below the surface of the repaved road, thus causing bumps and areas for water accumulation.

SUMMARY OF THE INVENTION

The present invention provides a kit for spacing the manhole frame above the chimney at the desired angle and sealing the ends of the spacer to the upper surface of the chimney and the lower surface of the manhole frame. The present invention also provides a method of using the kit to seal manhole frames to chimneys so that the manhole frame and manhole cover will be flush with the road surface. The kit and method of this invention result in spacers that may be easily replaced when the road is to be resurfaced.

In brief, the kit comprises a spacer, a bottom circular flange, and a top circular flange.

The spacer comprises a top end, a bottom end, an outer diameter, and an inner diameter. The spacer is preferably made of hard, sturdy polymeric material. The spacer has a thickness of nearly one inch and an inner diameter of such a size as to allow workers to pass through. Typically, this diameter is 27", 30", or 36".

The top and bottom flanges are identical in size and shape. The flanges are circular plates of sturdy polymeric material having a coaxial hole of a size to allow passage of a worker. The outer diameter is of such a size as to fit both the manhole chimney and the manhole frame.

The bottom surface of the bottom flange will rest upon the upper surface of the chimney. This surface contains a plurality of recesses which hold a sealant material for creating a watertight seal between the flange and the chimney. The top surface of the bottom flange contains two spaced-apart coaxial protrusions for holding the bottom end of the spacer fitted with a gasket.

The bottom surface of the top flange has two spaced-apart coaxial protrusions for holding the top end of the spacer fitted with a gasket. The top surface of the top flange will abut with the lower surface of the manhole frame. This surface contains a plurality of recesses which hold a sealant material for creating a watertight seal between the flange and the manhole frame.

The kit of this invention is simple to use. The recesses in the bottom surface of the bottom flange are filled with a sealant material and the bottom flange is sealed to the upper surface of the chimney using light pressure. The spacer is inserted into the space between the protrusions on the top surface of the bottom flange. The spacer is then measured and marked so as to obtain the proper length and grade. The spacer is then removed and cut with a conventional cutting tool. Gaskets are placed on the bottom and top ends of the spacer. The bottom end of the spacer is then securely installed onto the top surface of the bottom flange. The bottom surface of the top flange is then placed over the gasketed top end of the spacer so that the spacer is held within the spaced-apart protrusions. A secure connection is achieved with light pressure. The recesses in the top surface of the top flange are then filed with a sealant material and the manhole frame is sealed to the top flange with light pressure.

When the system is in place, the hole surrounding the spacer may be filled with fill dirt. Thus, when the road is repaved, a new connecting pipe, fitted and cut to achieve the proper grade, replaces the original connecting pipe and there is no need to dismantle and discard the entire system.

DESCRIPTION OF THE PREFERRED EMBODIMENTS

Figure 1:
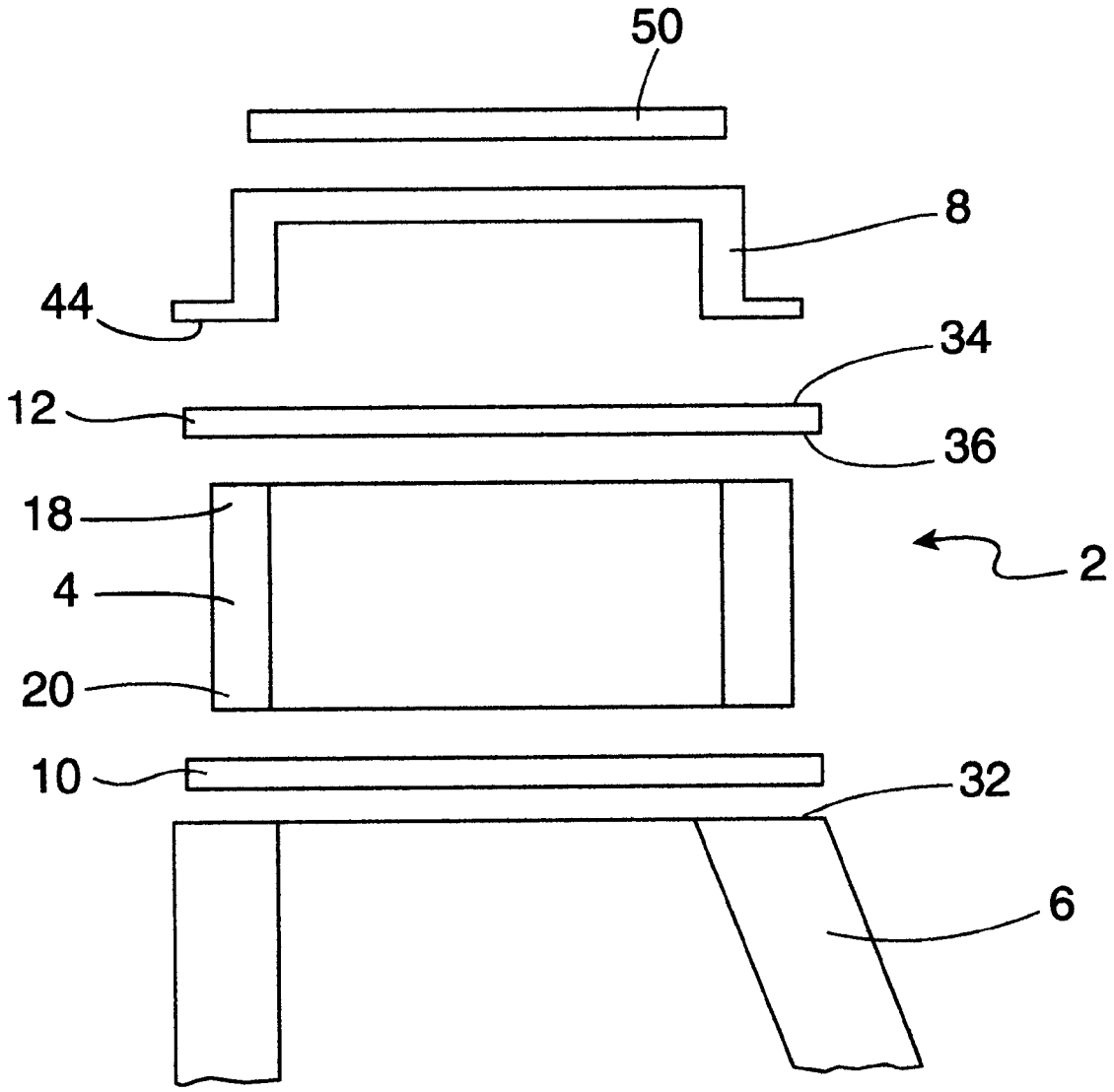
FIG. 1 is an exploded cross-sectional view of the spacer in place between two flanges, a chimney, and a manhole frame.
Figure 2:
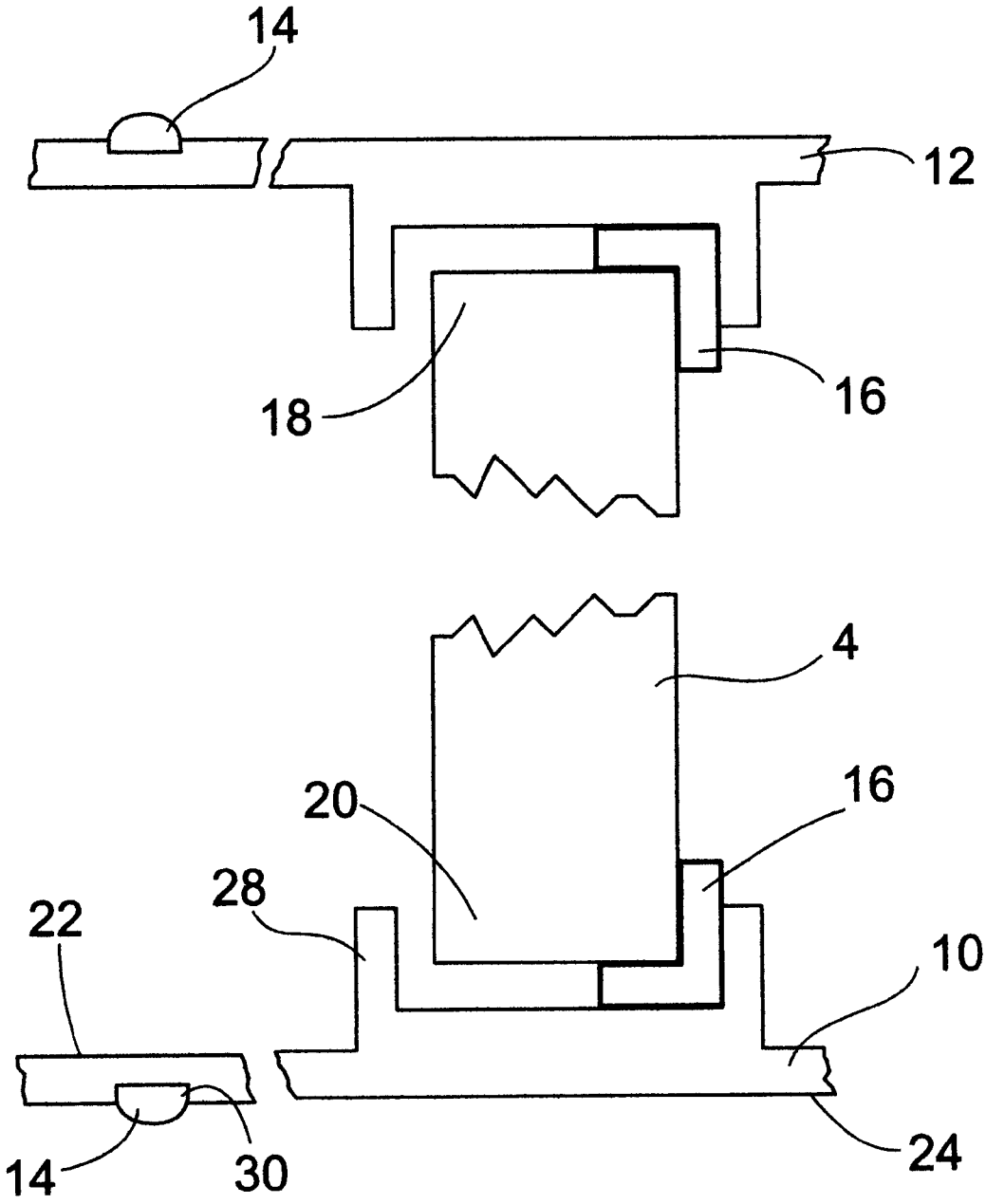
FIG. 2 is a cross-sectional view of the top and bottom flanges connected by the gasketed spacer.
Figure 3:
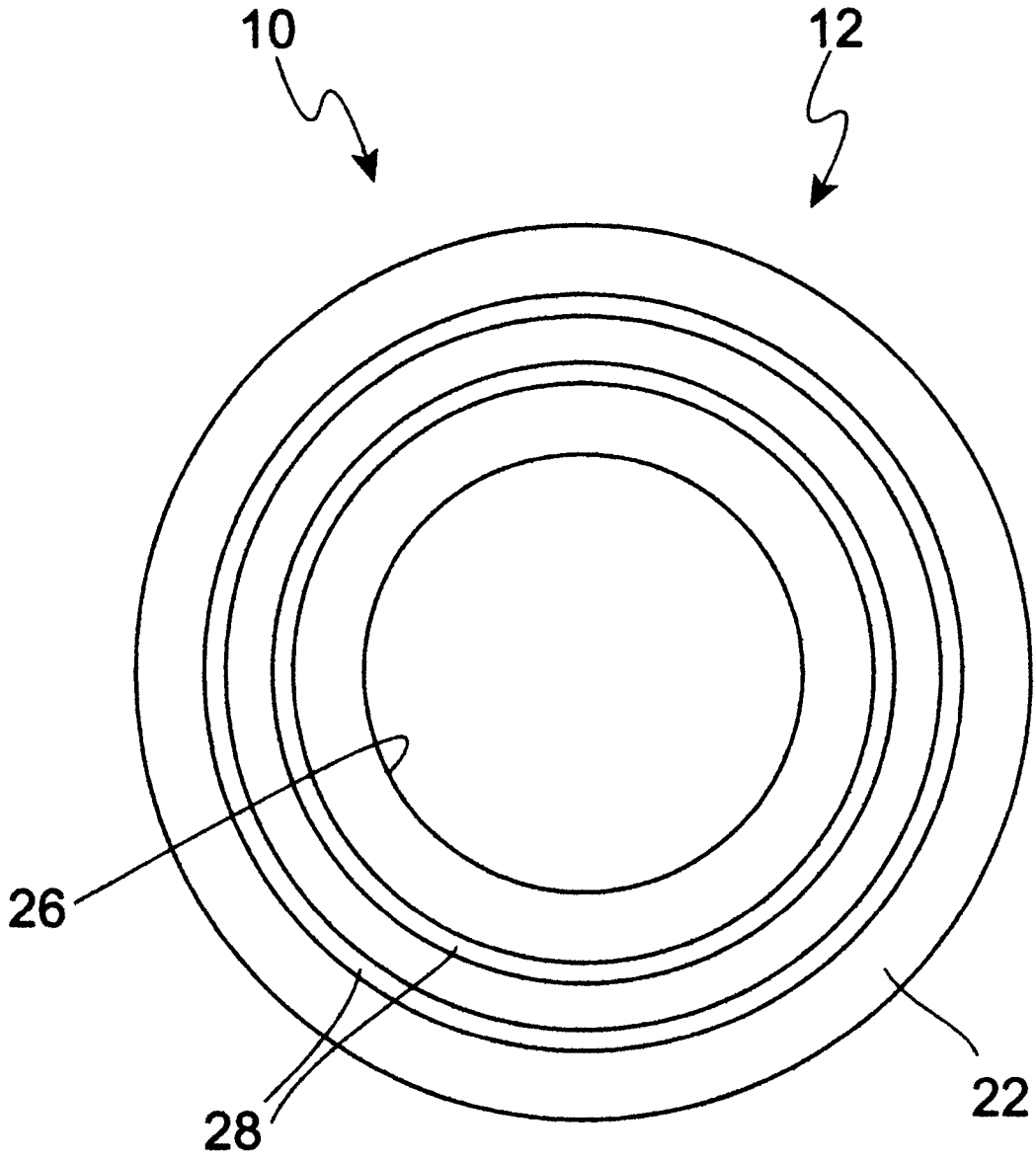
FIG. 3 is a plan view of the top surface of the bottom flange or the bottom surface of the top flange.
Figure 4:
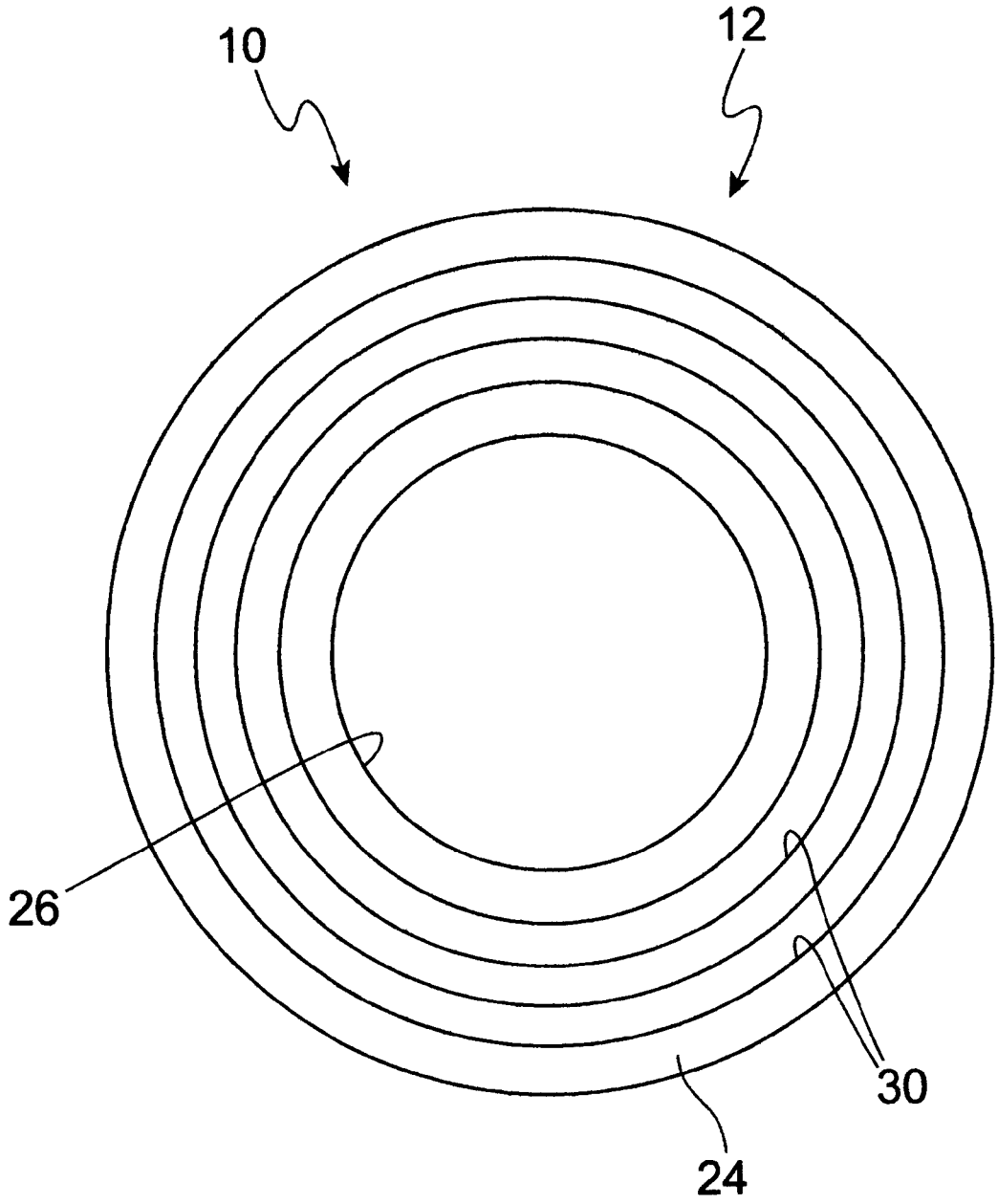
FIG. 4 is a plan view of the bottom surface of the bottom flange or the top surface of the top flange.
Figure 5:
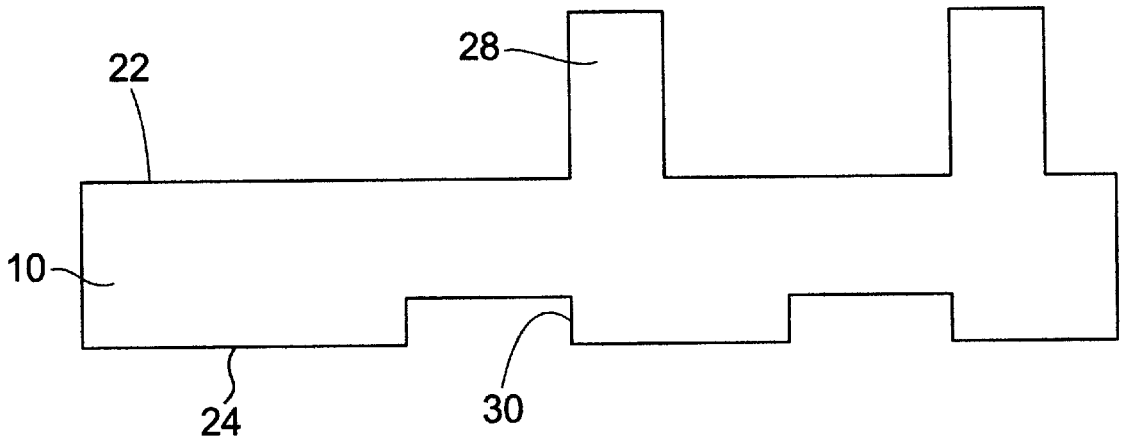
FIG. 5 is a cross-sectional view of one side of the bottom flange.
Figure 6:
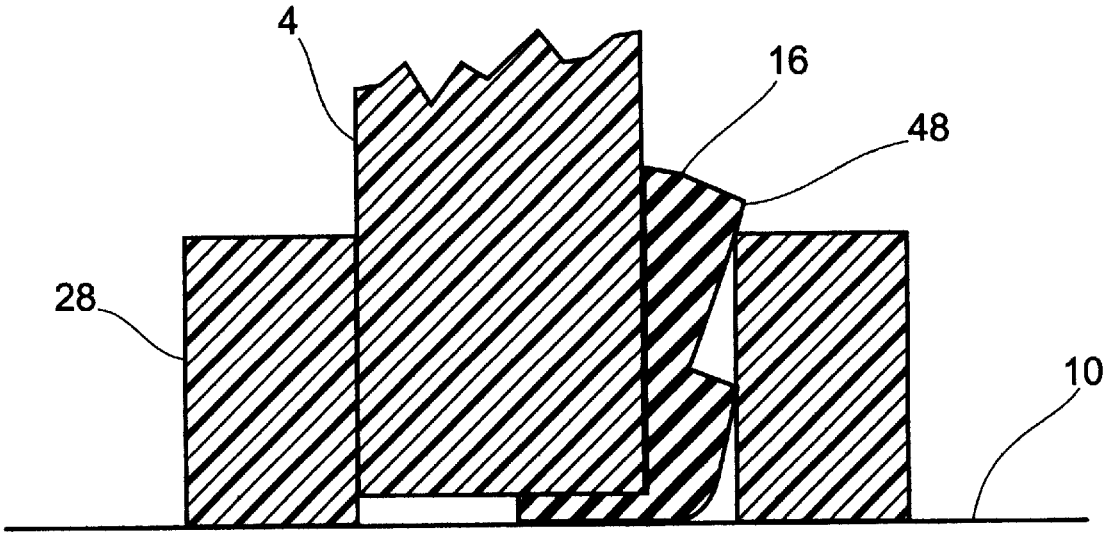
FIG. 6 is a cross-sectional view of one end of the spacer fitted between two protrusions with the help of the gasket.

The preferred embodiments of the present invention will now be described with reference to the above drawing, like identifying numerals referring to like features throughout.

The sealing kit 2 of the present invention comprises a spacer 4 for connecting a manhole chimney 6 to a manhole frame 8, a bottom circular flange 10, and a top circular flange 12. Other necessary items which may be sold with the kit or as individual items are a sealant material 14 for creating seals between the flanges 10 12 and the chimney 6 and the manhole frame 8 and gaskets 16 for securing a watertight fit between the spacer 4 and the flanges 10 12.

The spacer 4 has a top end 18, a bottom end 20, an outer diameter, and an inner diameter. The spacer 4 is made of hard sturdy polymeric material. The spacer 4 is conveniently supplied as a single piece of pipe having a length between two and three feet, a thickness of approximately one inch, and an inner diameter such as to allow the passage of a worker. Convenient outside diameters are 27", 30", and 36".

The bottom 10 and top flanges 12 are the same in size and configuration. This allows simplicity of manufacture. For economy and simplicity of construction, the flanges 10 12 are preferably made of a hard, sturdy polymeric material.

The bottom flange 10 is preferably circular in shape having a top surface 22, a bottom surface 24, an outer diameter, and a coaxial hole 26 for allowing the passage of a worker. The top surface 22 has a plurality (preferably two) of coaxial protrusions 28 so spaced so as to allow the gasketed 16 spacer 4 to fit between them and form a secure watertight seal. These protrusions 28 are preferably approximately one inch in height and there is a space between the protrusions 28 which is approximately one and one-half inches wide. The bottom surface 24 has a plurality of recesses 30 for holding sealant material 14. These recesses 30 may be simply a plurality of individual depressions scattered throughout the bottom surface. Preferably, in order to ensure a watertight seal, the plurality of recesses 30 take the form of a plurality (preferably two) of coaxial recesses 30 approximately one inch wide and one-quarter inch deep. The outer diameter is determined by the diameter of the upper surface 32 of the chimney 6. It is preferred that the outer diameter of the bottom flange 10 will be the same as the outer diameter of the chimney 6. A typical outer diameter is 36". When this is the case, the recesses 30 containing sealant material come into full contact with the upper surface 32 of the chimney 6 and allow for the creation of a watertight seal. The inner diameter is large enough to permit the passage of a worker. A typical inner diameter is 24".

The top flange 12 is preferably circular in shape having a top surface 34, a bottom surface 36, an outer diameter, and a coaxial hole 26 for allowing the passage of a worker. The top surface 34 has a plurality of recesses 30 for holding a sealant material 14. These recesses 30 may be simply a plurality of individual depressions scattered throughout the top surface. Preferably, in order to ensure a watertight seal, the plurality of recesses 30 take the form of a plurality (preferably two) of coaxial recesses 30 approximately one inch wide and one-quarter inch deep. The bottom surface 36 has a plurality (preferably two) of coaxial protrusions 28 so spaced so as to allow the gasketed 16 spacer 4 to fit between them and form a secure watertight seal. These protrusions 28 are preferably approximately one inch in height and create a space between the protrusions 28 which is approximately one and one-half inches wide. When the top end 18 of the spacer 4 is cut at an angle, the top end 18 will become an oval rather than a true circle. This slight variation from a true circle is easily compensated for by the width between the protrusions 28 being greater than that which allows only a snug fit and the pliability of the gasket 16. The outer diameter is determined by the diameter of the lower surface 44 of the manhole frame 8. It is preferred that the outer diameter of the top flange 12 will be the same as the outer diameter of the manhole frame 8. A typical outer diameter is 36". When this is the case, the recesses 30 containing sealant material 14 come into full contact with the lower surface 44 of the manhole frame 8 and allow for the creation of a watertight seal. The inner diameter is large enough to permit the passage of a worker. A typical inner diameter is 24".

The sealant material 14 may be any sealant material capable of forming a watertight seal between the polymeric material of the flanges 10 12 and each of the metallic or polymeric manhole frame 8 and the concrete chimney 6. Preferably, the sealant material 14 is a butyl rubber material in the form of a flexible rope which fits into the recesses 30 in the flanges 10 12.

The gasket 16 material is made of rubber or flexible polymeric material. The gasket 16 for the bottom end 20 of the spacer 4 is the same size and shape as that for the top end 18. The gaskets 16 may be provided in strips which may be cut to the appropriate length on site. The gaskets 16 are in the shape of an "L" wherein the bottom of the "L" contacts the bottom 20 (or top 18) of the spacer 4. Each gasket 16 has a pair of pliable lips 48 along the outer aspect of the long leg of the "L" in order to ensure a tight seal while allowing for differences in size of the spacer 4 and the space between the protrusions 28. The space between the two protrusions 28 which is not filled with the gasket 16 and the spacer 4 will be filled with a butyl rubber sealant to ensure a watertight fit between the spacer and the flange 10 12.

The practice of the method of this invention will now be described.

The method of this invention is useful for connecting manhole frames 8 to manhole chimneys 6 by means of a spacer 4 which can be cut on site to form the desired angle to allow the manhole frame 8 to hold the manhole cover 50 at the desired height and angle.

The recesses 30 in the bottom surface 24 of the bottom flange 10 are filled with sealant material 14, preferably in the form of a flexible rope of butyl rubber sealant material 14. The bottom flange 10 is then sealed to the upper surface 32 of the chimney 6.

The spacer 4 is put into the space between the protrusions 28 on the top surface 22 of the bottom flange 10, marked so as to achieve the desired length and angle, removed from the bottom flange 10, cut at the markings, fitted with gaskets 16 at the top 18 and bottom ends 20, and firmly reinserted into the space on the top surface 22 of the bottom flange 10 so as to form a watertight seal with the aid of a sealant between the protrusions 28, the spacer 4, and the gasket 16. It should be understood that the top gasket 16 may be fitted onto the top end 18 of the spacer 4 before of after the spacer 4 is inserted into the space on the top surface 22 of the bottom flange 10.

The space between the protrusions 28 on the bottom surface 36 of the top flange 12 is then fitted over the gasketed 16 top end 18 of the spacer 4 and the manhole frame 8 is sealed to the top surface 34 of the top flange 12 with the aid of a sealant in the same manner as the bottom flange 10 was sealed to the upper surface 32 of the chimney 6. The manhole cover 50 is then placed in the manhole frame 8. The space surrounding the spacer 4 may be filled with fill dirt rather than being cemented in place. Because of this, when the road is resurfaced, it is only necessary to remove the original spacer 4 and replace it with a new spacer 4 which is marked and cut at the new desired length and angle.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A kit for sealing a manhole cover frame to a chimney, said kit comprising:

A. a spacer comprising a flat top end, a flat bottom end, an outer diameter, and an inner diameter;

B. a bottom circular flange comprising:

i. a top surface having a plurality of coaxial protrusions so spaced as to allow the spacer to fit between them, ii. a bottom surface having a plurality of recesses for holding a sealant material, iii. an outer perimeter, and iv. a central hole for allowing passage of a worker; and C. a top circular flange comprising:

i. a top surface having a plurality of recesses for holding the sealant material, ii. a bottom surface having a plurality of coaxial protrusions so spaced as to allow the spacer to fit between them, iii. an outer perimeter, and iv. a central hole for allowing passage of a worker.

2. The kit of claim 1, wherein the spacer is made of plastic.

3. The kit of claim 1, wherein the top and bottom flanges are made of plastic.

4. The kit of claim 1 wherein the recesses in the top and bottom flanges for holding the sealant material are coaxial recesses.

5. The kit of claim 4, additionally containing the sealant material in the form of a flexible rope.

6. The kit of claim 5, wherein the sealant material is butyl rubber.

7. The kit of claim 1, further including a gasket for each end of the spacer.

8. The kit of claim 7, wherein the gasket is "L"-shaped having at least one pliable lip on the outer surface of the long leg of the "L".

9. A method of connecting a manhole cover frame having a lower surface to a chimney having an upper surface, the manhole cover frame being capable of supporting a manhole cover on a graded surface, which method comprises:

I. providing a kit for sealing the manhole cover frame to the chimney, said kit comprising:

A. a spacer forming a pipe having a top end, a bottom end, an outer diameter, and an inner diameter;

B. a bottom circular flange comprising:

i. a top surface having a plurality of coaxial protrusions so spaced as to allow the spacer to fit between them, ii. a bottom surface having a plurality of recesses for holding a sealant material, iii. an outer diameter, and iv. a central hole for allowing passage of a worker; and C. a top circular flange comprising:

i. a top surface having a plurality of recesses for holding the sealant material, ii. a bottom surface having a plurality of coaxial protrusions so spaced as to allow the spacer to fit between them, iii. an outer diameter, and iv. a central hole for allowing passage of a worker;

II. laying the bottom flange so that its bottom surface is facing up;

III. filling the recesses of the bottom surface of the bottom flange with the sealant material;

IV. placing the bottom surface of the bottom flange onto the upper surface of the chimney and creating a watertight seal between the chimney and the bottom flange with light pressure;

V. cutting the top end of the spacer so that the pipe will have the proper length and the top end will have an angle appropriate for the grade;

fitting the bottom end of the spacer between the protrusions on the top surface of the bottom flange and creating a watertight seal;

VI. fitting the top end of the spacer between the protrusions on the bottom surface of the top flange and creating a watertight seal;

VII. filling the recesses of the top surface of the top flange with the sealant material; and VIII. placing the lower surface of the manhole cover frame onto the top surface of the top flange and creating a watertight seal.

10. The method of claim 9, wherein the spacer is made of plastic.

11. The method of claim 9, wherein the top and bottom flanges are made of plastic.

12. The method of claim 9, wherein the recesses in the top and bottom flanges for holding the sealant material are coaxial recesses.

13. The method of claim 12, wherein the sealant material is in the form of a flexible rope.

14. The method of claim 13, wherein the sealant material is butyl rubber.

15. A method of connecting a manhole cover frame having a lower surface to a chimney having an upper surface, the manhole cover frame being capable of supporting a manhole cover on a graded surface, which method comprises:

I. providing a kit for sealing the manhole cover frame to the chimney, said kit comprising:

A. a spacer forming a pipe having a top end, a bottom end, an outer diameter, and an inner diameter;

B. a bottom circular flange comprising:

i. a top surface having a plurality of coaxial protrusions so spaced as to allow the spacer to fit between them, ii. a bottom surface having a plurality of recesses for holding a sealant material, iii. an outer diameter, and iv. a central hole for allowing passage of a worker; and C. a top circular flange comprising:

i. a top surface having a plurality of recesses for holding the sealant material, ii. a bottom surface having a plurality of coaxial protrusions so spaced as to allow the spacer to fit between them, iii. an outer diameter, and iv. a central hole for allowing passage of a worker;

II. laying the bottom flange so that its bottom surface is facing up;

III. filling the recesses of the bottom surface of the bottom flange with the sealant material;

IV. placing the bottom surface of the bottom flange onto the upper surface of the chimney and creating a watertight seal between the chimney and the bottom flange with light pressure;

V. cutting the top end of the spacer so that the pipe will have the proper length and the top end will have an angle appropriate for the grade;

VI. applying gaskets to the bottom and top ends of the spacer;

VII. fitting the gasketed bottom end of the spacer between the protrusions on the top surface of the bottom flange and creating a watertight seal;

VIII. fitting the gasketed top end of the spacer between the protrusions on the bottom surface of the top flange and creating a watertight seal;

IX. filling the recesses of the top surface of the top flange with the sealant material; and X. placing the lower surface of the manhole cover frame onto the top surface of the top flange and creating a watertight seal.

16. The method of claim 15, wherein the gasket is "L"-shaped having at least one pliable lip on the outer surface of the long leg of the "L".

* * * * *